US006941659B2

(12) United States Patent
Gilder

(10) Patent No.: US 6,941,659 B2
(45) Date of Patent: Sep. 13, 2005

(54) SAFETY RAZORS

(75) Inventor: Bernard Gilder, Twyford (GB)

(73) Assignee: The Gillette Company, Boston, MA (US)

( * ) Notice: Subject to any disclaimer, the term of this patent is extended or adjusted under 35 U.S.C. 154(b) by 109 days.

(21) Appl. No.: 10/688,007

(22) Filed: Oct. 15, 2003

(65) Prior Publication Data

US 2004/0078979 A1 Apr. 29, 2004

Related U.S. Application Data

(62) Division of application No. 09/852,904, filed on May 9, 2001, now abandoned, which is a continuation of application No. PCT/WO99/29709, filed on Dec. 15, 1999.

(30) Foreign Application Priority Data

Dec. 21, 1998 (GB) ..... 9828215

(51) Int. Cl.[7] ..... B26B 21/44

(52) U.S. Cl. ..... 30/34.2; 30/34.05; 30/41; 30/50; 30/77; 30/81

(58) Field of Search ..... 30/34.2, 41, 32, 30/34.05, 41.5, 50, 70, 74.1, 77, 81, 82, 83, 84, 537, 538

(56) References Cited

U.S. PATENT DOCUMENTS

| | | | | | |
|---|---|---|---|---|---|
| 2,600,880 | A | * | 6/1952 | Karle | 30/537 |
| 4,697,342 | A | * | 10/1987 | Ferraro | 30/41 |
| 4,850,107 | A | * | 7/1989 | Valliades et al. | 30/41 |
| 4,944,090 | A | | 7/1990 | Sumnall | 30/41 |
| 5,056,222 | A | | 10/1991 | Miller et al. | 30/77 |
| 5,113,585 | A | | 5/1992 | Rogers et al. | 30/41 |
| 5,689,883 | A | | 11/1997 | Ortiz et al. | 30/34.2 |
| 5,711,076 | A | | 1/1998 | Yin et al. | 30/41 |
| 6,412,176 | B1 | * | 7/2002 | Prochaska et al. | 30/34.2 |
| 6,807,739 | B2 | * | 10/2004 | Follo | 30/41 X |
| 2003/0159291 | A1 | * | 8/2003 | Clark | 30/50 |
| 2004/0025350 | A1 | * | 2/2004 | Richard et al. | 30/50 |

FOREIGN PATENT DOCUMENTS

| | | | |
|---|---|---|---|
| EP | 0 858 870 | 8/1998 | |
| GB | 2119690 | 11/1983 | |
| WO | WO 94/11163 | * 5/1994 | 30/50 |
| WO | WO 97/25190 | 7/1997 | |
| WO | WO 97/33729 | 9/1997 | |
| WO | WO 97/35693 | 10/1997 | |
| WO | WO 99/14020 | 3/1999 | |

* cited by examiner

*Primary Examiner*—Clark F. Dexter
(74) *Attorney, Agent, or Firm*—Fish & Richardson P.C.

(57) ABSTRACT

A guard of a safety razor blade unit has a lubricating strip (24) disposed in front of a backstop (23), and the edge of the backstop which contacts the skin during shaving is castellated to define channels (30) separated by lands (31). The channels (30) enable an effective layer of lubricant to remain on the skin until the blade positioned to the rear of the backstop contacts the skin in the course of a shaving stroke.

20 Claims, 4 Drawing Sheets

SAFETY RAZORS

This application is a divisional (and claims the benefit of priority under 35 USC 120) of U.S. application Ser. No. 09/825,904, filed May 9, 2001, now abandoned which is continuation of PCT/US99/29709, filed Dec. 15, 1999, and Great Britain application Ser. No. 9828215.5, filed Dec. 12, 1998. The disclosure of the prior application is considered part of (and is incorporated by reference in) the disclosure of this application.

This invention relates to safety razors and in particular is concerned with a guard structure for a safety razor blade unit. In general a blade unit of a safety razor has at least one blade with a cutting edge which is moved across the surface of the skin being shaved by means of a handle to which the blade unit is attached. The blade unit may be mounted detachably on the handle to enable the blade unit to be replaced by a fresh blade unit when the blade sharpness has diminished to an unsatisfactory level, or it may be attached permanently to the handle with the intention that the entire razor be discarded when the blade or blades have become dulled. Razor blade units usually include a guard which contacts the skin in front of the blade(s) and a cap for contacting the skin behind the blade(s) during shaving. The cap and guard serve important roles in establishing the so-called "shaving geometry", i.e. the parameters which determine the blade orientation and position relative to the skin during shaving, which in turn have a strong influence on the shaving performance and efficacy of the razor.

It is known to provide safety razor blade units with rigid guards, for example formed integrally with a frame or platform structure which provides a support for the blades. Also known are guards which include an elastomeric strip with a surface configuration intended to produce pleasant tactile sensations on contact with the skin during shaving and/or to interact with the hairs in a favorable manner immediately before they are cut by a blade of the blade unit moving across the skin and following the guard structure. Some guards, such as those incorporating elastomeric strips with surfaces which are not well defined due to deformations which can take place, are equipped with a so-called "backstop" which has a top edge surface arranged to have continuous contact with the skin along the length of the backstop which extends parallel to the cutting edge of the blade which is located directly behind the backstop at a small distance therefrom. Another feature commonly found in safety razor blade units which have been marketed in recent years is a lubricating strip, which can be positioned on the guard or the cap, as described, for example, in U.S. Pat. No. 4,944,090 and U.S. Pat. No. 5,711,076. The lubricating strip includes a lubricant carried within a matrix structure so that lubricant is gradually released during shaving and becomes deposited onto the skin as the lubricating strip slides over the skin surface. The lubricant delivered by a lubricating strip is beneficial in reducing friction between the blade unit and the skin as the blade unit is moved over the skin surface.

It has now been observed that skin protection, comfort and smoothness are increased as the thickness of a layer of lubricant between the skin and blade increases, and this can result in overall benefits and superior performance. A lubricating strip located on the guard can be more effective in promoting an effective layer of lubricant between the skin and blade than a lubricating strip disposed on the cap of the blade unit, except that, where a backstop is interposed between the lubricating strip and the blade, the backstop will tend to scrape or wipe the lubricant from the skin directly in front of the blade.

According to the present invention there is provided a guard for a safety razor blade unit, comprising: a lubricating element for delivery of lubricant to the skin during shaving; and a backstop having an upper edge disposed to contact the skin during shaving in front of a blade edge and behind the lubricating strip, wherein the skin contacting edge of the backstop is interrupted by one or more channels to facilitate passage of lubricant to the blade during shaving.

The provision of depressions in the top edge of the backstop to define the channels can allow an improved delivery of lubricant carried on the skin to the point of contact between the skin and the blade, without detracting from the ability of the backstop to establish the shaving geometry in accordance with its primary function, and as a consequence an overall improvement in safety of the blade unit can be achieved.

It may be mentioned that there have been various proposals to mount a razor blade on a platform formed like a comb with teeth which protrude forwardly of the blade edge in order to control the skin bulge which tends to form directly in front of the blade edge. In some constructions no further guard structure is provided and as a result there is no provision for locating a lubricating strip in advance of the blade, and where an additional guard structure is provided a conventional backstop is usually included. It is also known, e.g. from GB 2119690, U.S. Pat. No. 4,944,090, EP-A-0858870, and W097/35693 to provide a segmented guard structure so that the blade unit is able to flex along its length.

In a preferred embodiment of the invention the backstop has a castellated form so that there are a plurality of channels uniformly distributed along the backstop. The channels are preferably at least as wide as the lands between the channels, and the channels may be up to 3 mm wide. The depth of the channels is suitably from 0.1 to 2 mm, e.g. in the range of 0.3 to 0.8 mm. The shape of the channels is not critical and a rectangular shape with upright side walls and a substantially flat bottom wall is appropriate.

The guard may additionally include an elastomeric strip, in which case it is preferable for the lubricating element to be disposed between the elastomeric strip and the backstop, but this is not essential. Advantageously the lubricating element is directly in front of the backstop and has its upper surface disposed at a level intermediate the channel bottom and the skin contacting edge of the backstop.

The elastomeric strip, if included, can take a variety of different forms, including those according to prior art proposals. For example, the elastomeric strip may have upstanding discrete projections, e.g. tubes or crescent shaped projections, or fins extending either parallel to the blade edge or transverse thereto. Specific forms of elastomeric strip are described for example in WO 97/25190 and WO 97/33729 the contents of which are incorporated herein by reference.

The backstop may be integral with a frame of the blade unit. As an alternative the backstop may be formed of elastomeric material, as described in U.S. Pat. No. 5,711,076, or a layer of elastomeric material, which may be integral with an elastomeric strip as described above, may be disposed to overlie the backstop, as generally described in our co-pending International patent application No. PCT/GB98/02732, the contents of which are incorporated herein by reference, so that an uppermost portion of the backstop can be compressively deformed or deflected under forces experienced during shaving, although the layer of elastomeric material will be confined to the lands, or alternatively might form the lands, between the channels.

A full understanding of the invention, will be gained from the following detailed description of some exemplary embodiments, reference being made to the accompanying drawings, in which.

Figure 1:
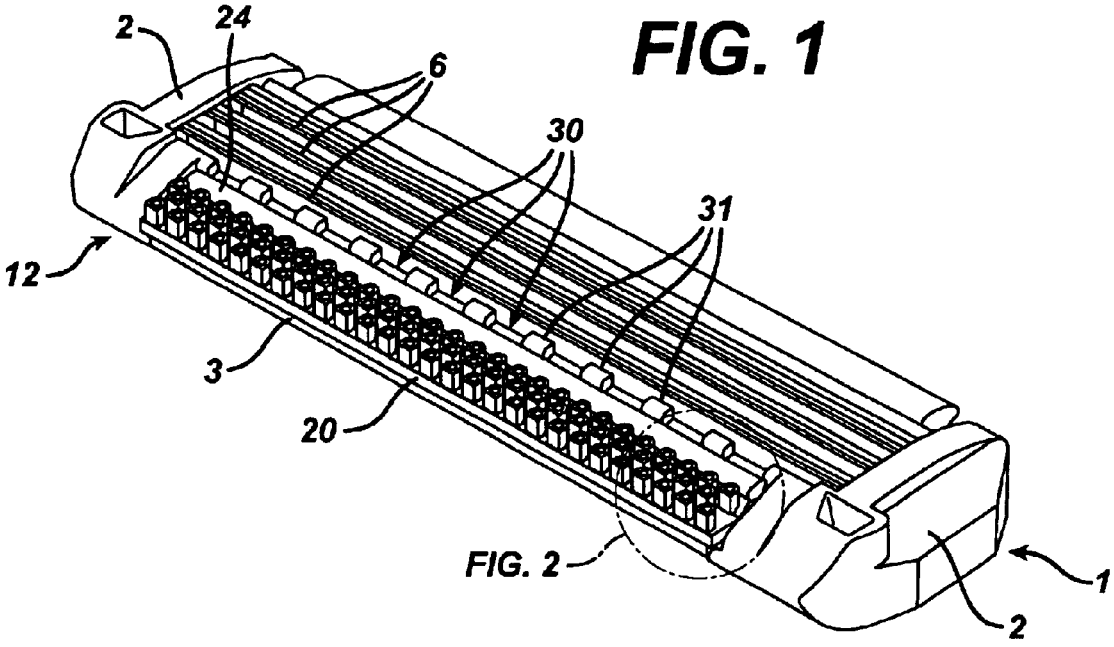
FIG. 1 is an isometric view of a safety razor blade unit incorporating a guard in accordance with the invention.
Figure 2:
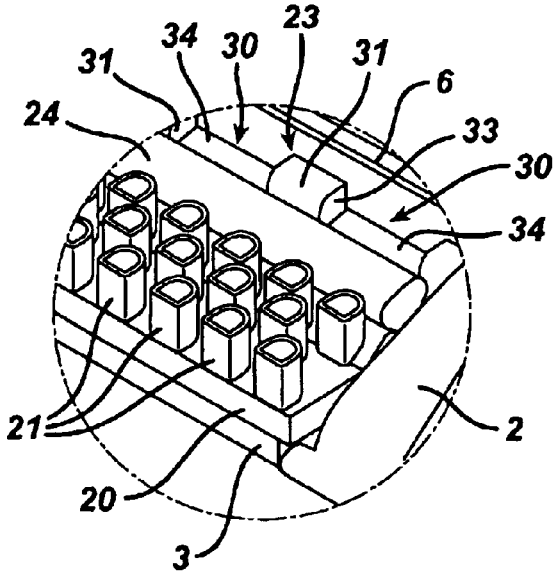
FIG. 2 is an enlarged scale view of the part of the blade unit shown circled in FIG. 1.
Figure 3:
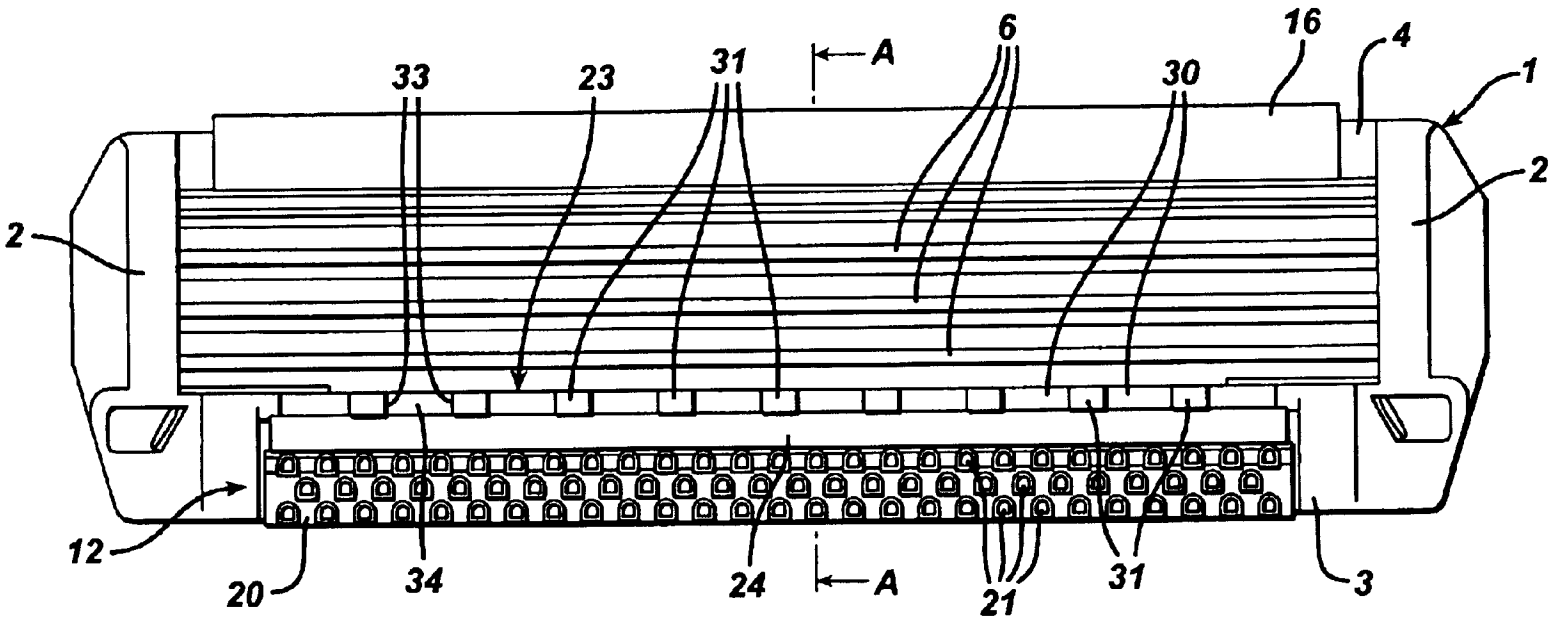
FIG. 3 shows the blade unit of FIG. 1 in plan view.
Figure 4:
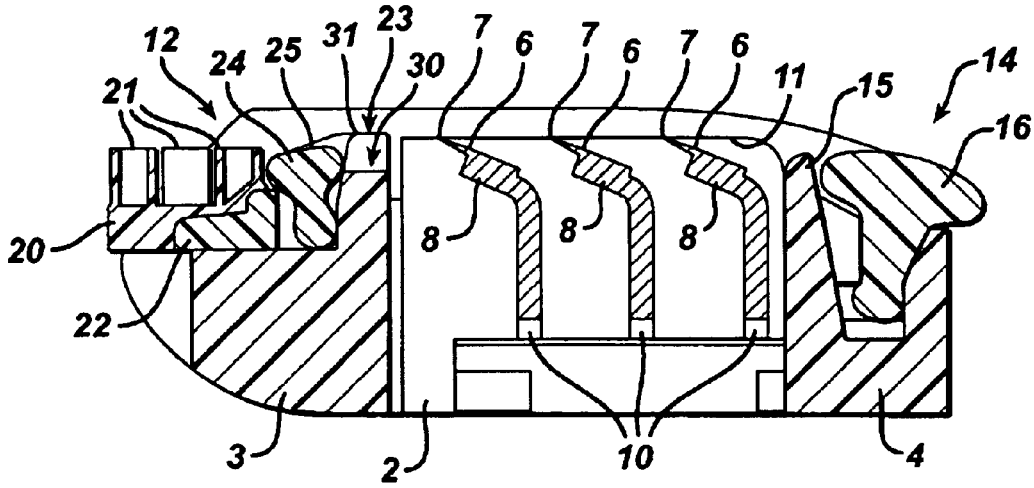
FIG. 4 is a cross-section taken along the line A—A of FIG. 3.

Illustrated in FIGS. 1–4 is a safety razor blade unit which is intended to be replaceably mounted on a handle. Blade units of this general type are commonly referred to as "cartridges". The blade unit or cartridge may be fixedly mounted on the handle or it can be pivotable about an axis which extends parallel to the blade edges. The illustrated blade unit comprises a generally rectangular blade housing or frame 1 moulded from rigid plastics material and having end walls 2 interconnected by front and rear members 3,4. Mounted in the frame for movement independently of each other are three blades 6 with sharpened forward edges 7 and carried on respective blade supports 8 guided in slots 10 defined on the end walls of the frame. The blade supports 8, and hence the blades 6, are movable downwardly against the action of springs (not shown), the upward movement of the blades due to the springs being limited by abutment of the blades 6 with shoulders 11 on the end walls 2 of the frame 1. The blade unit includes a guard structure 12 and a cap structure 14 for respectively contacting the skin in front of and behind the blades during shaving. The cap structure includes a bar 15 integral with the frame and a lubricating strip 16 of a kind well known in the wet shaving art. Suitable materials for the lubricating strip 16 are those described in our U.S. Pat. No. 5,113,585 the contents of which are incorporated herein by reference.

The guard structure 12 includes an elastomeric strip 20 with three staggered rows of upstanding hollow tubes 21 of D-shaped cross section, a backstop 23 and a lubricating element 24 in the form of a continuous strip firmly held in a slot defined between the elastomeric strip 20 and the backstop 23. The material of the elastomeric strip 20, which is carried on a platform 22 fixed to the frame 1 of the blade unit, is chosen to provide an appropriate flexibility of the projections 21 so as to produce a desirable tactile sensation during shaving. Suitable materials for the elastomeric strip are those having a hardness value in the range of 27 to 75 on the Shore A scale and specific materials having appropriate characteristics include (I) Kraton G2705 having a hardness of 55 on the Shore A scale manufactured by the Shell Corporation, (ii) Evoprene #966 having a Shore A hardness value of 27 and distributed by Gary Chemical Corporation of Leominster, Mass., (iii) Santoprene 271-55 having a Shore A hardness value of 55 and manufactured by Advanced Elastomerics Corporation and (iv) Santoprene 271-73 having a Shore A hardness value of 73 and also manufactured by Advanced Elastomerics Corporation.

The backstop 23 is integrally moulded with the front member 3 of the frame 1 and is castellated with a series of depressions or recesses in its top edge defining channels 30 separated by lands 31. The channels 30 are uniformly distributed along the backstop at a pitch of 3 mm. In the illustrated embodiment the width of the channels is substantially equal to 2 mm with the lands 31 between the channels having a width substantially equal to 1 mm, i.e. approximately half the channel width. As shown the channels 30 are generally rectangular with upright side walls 33 and a substantially flat bottom wall 34, but other shapes, such as U-shape, will be acceptable. The channel depth is preferably at least 0.1 mm, for example around 0.5 mm, and the lubricating strip 24 is arranged with its upper skin contacting surface 25 at a level which is between the top edge surface of the backstop as defined by the lands 31 and the bottom walls 34 of the channels 30. The lubricating strip 24 is smaller than the lubricating strip 16 carried by the cap of the blade unit, but is may be made of the same lubricating material. Suitable materials for the lubricating strip 24 are those described in U.S. Pat. No. 5,113,585 mentioned above or those described in U.S. Pat. No. 5,711,076, the contents of which are also incorporated herein by reference. The lubricating strip 24 of the guard structure 12 releases lubricant onto the skin at a location in front of the blades 6, and the channels 30 provided in the backstop 23 allow lubricant carried by the skin when meeting the backstop, whether originating from the lubricating strip 24 or from elsewhere, to pass across the backstop so that an effective coating of lubricant remains on the skin when it is contacted by the leading blade edge 7.

Figure 5:
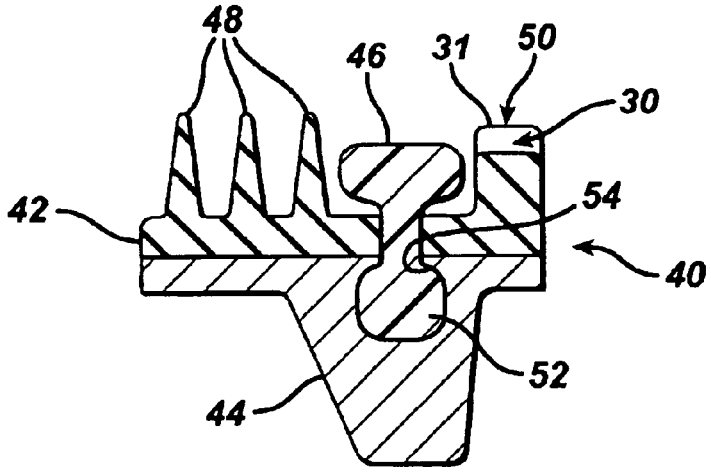
FIG. 5 illustrates in cross-section an alternative guard structure embodying the invention.

In FIG. 5 there is shown a modified guard structure 40 in which the elastomeric strip 42, lubricating strip 46 and backstop 50 are carried on a rigid support platform 44, the lubricating strip having a cross-section of approximately dumbbell shape and with a lower part 52 being held by a re-entrant groove 54 provided in the platform. The backstop has an upper edge interrupted along its length by rectangular depressions forming channels 30 separated by lands 31 as described above in connection with FIGS. 1 to 4. The backstop 50 can be made of elastomeric material and may for example be made of the same material as the elastomeric strip 42 and be moulded onto the platform 44 simultaneously with the strip 42. As shown the elastomeric strip 42 is provided with a series of three parallel upstanding fins 48, although it could have projections of different form, such as tubes of D-shaped cross section as in the embodiment of FIGS. 1 to 4.

Figure 6:
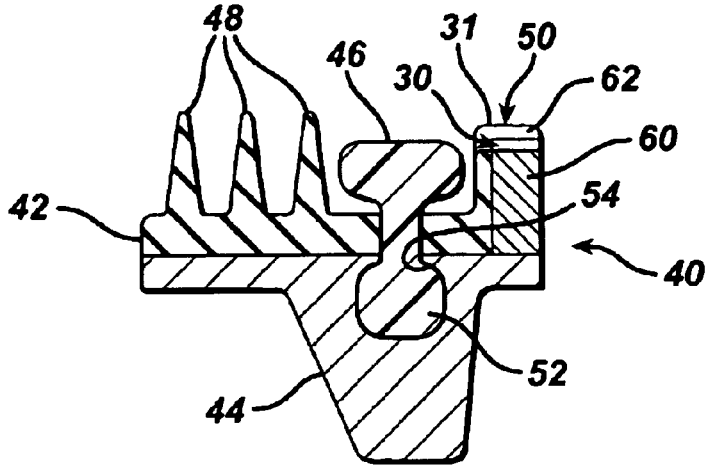
FIG. 6 shows a modified form of the guard structure of FIG. 5.

FIG. 6 illustrates a modified guard structure in which the backstop 50 includes a rigid wall 60, which could be integrally moulded with the platform 44. There is a layer of elastomeric material 62 which covers the front surface of this rigid wall and extends over the lands 31 between the channels 30 so that the top edge portion of the backstop 50 can be compressively deformed under forces exerted thereon during shaving. The elastomeric material 62 could be moulded to form the lands 31 in which case the elastomeric material would extend the full depth of the channels 30. Also, instead of being in abutment with the top surfaces of the lands 31, the elastomeric covering layer 62 could be arranged to extend over the lands 31 with a clearance therebetween so that the uppermost portion of the backstop 50 formed by the elastomeric material 62 can deflect resiliently downwardly under the action of forces imposed thereon during shaving.

By including a lubricating strip and having a backstop with channels to facilitate passage of lubricant carried by the skin into the region of the blades, the described guard structures can contribute to improved safety in use of the blade unit in which the guard structure is incorporated. Whilst it is apparent that modifications to the specifically described embodiments can be made within the spirit and scope of the present invention, it is our intention, however, to be limited only by the scope of the amended claims. One possible modification would be for the lubricating strip of the guard to be moulded in situ in combination with the backstop and for portions of the lubricating strip to extend into the channels formed by the backstop.

The castellated backstop with one or more channels as described herein is of particular benefit when used in conjunction with a lubricant applying element disposed on the guard in front of the backstop. However, lubricant can be applied to the skin separately and the backstop may be beneficial without a lubricating element included on the guard, especially if used in conjunction with an elastomeric strip with discrete upstanding projections, such as tubes with D-shaped cross-sections as used in the specific embodiment described above, which provide paths between the projections through which lubricant can pass.

What is claimed is:

1. A safety razor blade unit, comprising: a frame supporting a plurality of blades with parallel cutting edges on a front portion of the blades; and a guard disposed in front of the cutting edges of the blades, the guard comprising a lubricating element for delivery of lubricant to the skin during shaving, and a backstop having an upper surface disposed between the blades and the lubricating element and disposed to contact the skin during shaving, wherein the skin contacting upper surface of the backstop is interrupted by one or more channels running from the lubricating element toward the blades to facilitate the passage of lubricant to the blades during shaving.

2. A blade unit according to claim 1, wherein the backstop includes a plurality of said channels separated by lands forming said skin contacting upper surface.

3. A blade unit according to claim 2, wherein the channels are not more than 3 mm wide.

4. A blade unit according to claim 3, wherein the channels are at least as wide as the lands.

5. A blade unit according to claim 2, wherein the lands and channels are arranged alternately along the backstop at a uniform pitch.

6. A blade unit according to claim 2, the guard further including an elastomeric strip disposed forwardly of the backstop.

7. A blade unit according to claim 6, wherein the lubricating element is disposed between the elastomeric strip and the backstop.

8. A blade unit according to claim 6, wherein the elastomeric strip has up standing projections thereon.

9. A blade unit according to claim 8, wherein the upstanding projections are tubular with open ends.

10. A blade unit according to claim 9, wherein the tubular projections are D-shaped in cross section and oriented with their flat faces directed away from the backstop.

11. A blade unit according to claim 1, wherein the channel depth is in the range of 0.1 to 2 mm.

12. A blade unit according to claim 11, wherein the channel depth is in the range of 0.3 to 0.8 mm.

13. A blade unit according to claim 12, wherein the channels one of more have substantially upright side walls and a substantially flat bottom wall.

14. A blade unit according to claim 1, including an elastomeric strip disposed forwardly of the backstop.

15. A blade unit according to claim 14, wherein the lubricating element is disposed between the elastomeric strip and the backstop.

16. A blade unit according to claim 14, wherein the elastomeric strip has upstanding projections thereon.

17. A blade unit according to claim 16, wherein the upstanding projections are tubular with open ends.

18. A blade unit according to claim 17, wherein the tubular projections are D-shaped in cross section and oriented with their flat faces directed away from the backstop.

19. A blade unit according to claim 1, wherein the skin contacting upper surface of the backstop is defined by elastomeric material.

20. A blade unit according to claim 1, wherein the lubricating element is located immediately in front of the backstop and has an upper surface disposed at a level intermediate the bottom of the one of more channels and the skin contacting upper surface of the backstop.

* * * * *

UNITED STATES PATENT AND TRADEMARK OFFICE

CERTIFICATE OF CORRECTION

PATENT NO. : 6,941,659 B2
DATED : September 13, 2005
INVENTOR(S) : Bernard Gilder It is certified that error appears in the above-identified patent and that said Letters Patent is hereby corrected as shown below:

Column 6,
Line 5, "up standing" should be -- upstanding --.
Line 17, "channels one of more" should be -- one or more channels --.

Signed and Sealed this

Eighteenth Day of April, 2006

JON W. DUDAS
*Director of the United States Patent and Trademark Office*